US009685706B2

(12) United States Patent
Choon et al.

(10) Patent No.: US 9,685,706 B2
(45) Date of Patent: Jun. 20, 2017

(54) FULL-BAND ANTENNA SYSTEM

(71) Applicants: Tan Yew Choon, Singapore (SG); Ng Guan Hong, Singapore (SG); Tay Yew Siow, Singapore (SG)

(72) Inventors: Tan Yew Choon, Singapore (SG); Ng Guan Hong, Singapore (SG); Tay Yew Siow, Singapore (SG)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 106 days.

(21) Appl. No.: 14/930,225

(22) Filed: Nov. 2, 2015

(65) Prior Publication Data

US 2016/0322700 A1 Nov. 3, 2016

(30) Foreign Application Priority Data

Apr. 29, 2015 (CN) ..... 2015 1 0212532

(51) Int. Cl.
*H01Q 9/42* (2006.01)
*H01Q 1/24* (2006.01)

(52) U.S. Cl.
CPC ..... *H01Q 9/42* (2013.01); *H01Q 1/243* (2013.01)

(58) Field of Classification Search
CPC ..... H01Q 9/42; H01Q 1/243
USPC ..... 343/860
See application file for complete search history.

*Primary Examiner* — Dameon E Levi
*Assistant Examiner* — Andrea Lindgren Baltzell
(74) *Attorney, Agent, or Firm* — Na Xu; IPro, PLLC

(57) ABSTRACT

The disclosure provides a full-band antenna system including a metal backing and a main antenna module. The metal backing includes a header, a middle cover and a lower head. The main antenna module includes a circuit board, a feed part on the circuit board, a ground point and a matching circuit. The circuit board includes a substrate and an earth plate. The feed part and the matching circuit are located on the substrate, and the ground point is on the earth plate. The matching circuit is connected with the feed part, including a variable capacitance. By the variable capacitance of the matching circuit, it is beneficial to adjust the performance of antenna of all range of frequency conveniently and optimize the antenna's radiant efficiency up to the utmost extent.

9 Claims, 3 Drawing Sheets

FULL-BAND ANTENNA SYSTEM

FIELD OF THE INVENTION

The invention involves the mobile communication industry, especially involves a kind of full-band antenna system for the mobile phone.

DESCRIPTION OF RELATED ART

With the continuous development of the mobile terminal devices, such as mobile phone and tablet personal computer, people's demand for the devices' appearance is becoming higher and higher. At the same time, the device which has a metal case becomes popular among consumers because of its texture and abrasive resistance.

The related technological metal case usually has forms of closed ring, metal ring with gap, or metal backing. Metal cases in these forms bring big challenge to the antenna design of mobile terminal devices, for example the mobile phone. These closed or not-closed metal rings and metal backings are usually taken as a part of the antenna. Because the length of the ring or the backing is certain, it is difficult to debug the resonant frequency of the antenna, and its performance is worse.

Thus, it is necessary to provide a new type of antenna system for the mobile phone to solve the problems mentioned above.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of present disclosure more apparent, the present disclosure is described in further detail together with the figures and the embodiment. It should be understood the specific embodiment described hereby is only to explain this disclosure, not intended to limit this disclosure.

Figure 1:
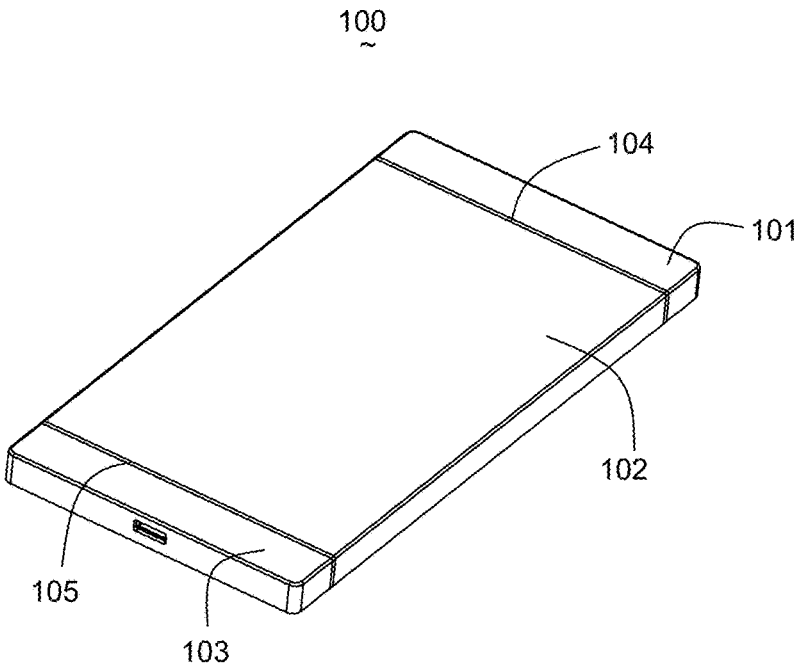
FIG. 1 is a structure diagram of a metal backing of a full-band antenna system in accordance with an exemplary embodiment of the present disclosure.
Figure 2:
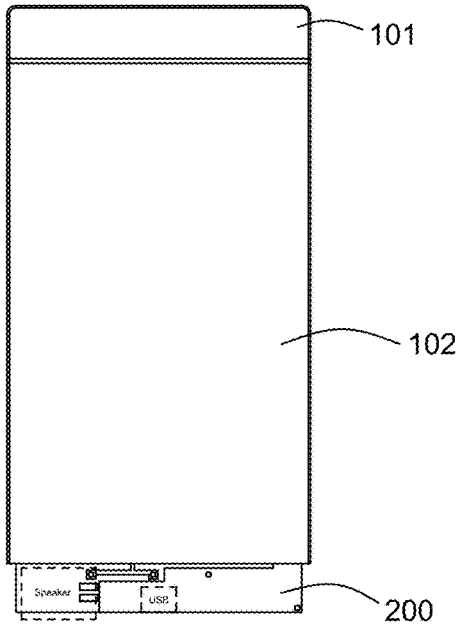
FIG. 2 is a structure diagram of the full-band antenna system after taking out a lower head thereof.

As shown in FIG. 1 and FIG. 2, a full-band antenna system in accordance with an exemplary embodiment of the present disclosure includes a metal backing 100 and a main antenna module 200. At both ends of the metal backing 100, there exist respectively two paralleled narrow crevices:

crevice 104 and crevice 105. Crevice 104 and crevice 105 divide the whole metal backing 100 into three parts: a header 101, a middle cover 102, and a lower head 103. Widths of crevices 104, 105 are the main factors that affect the performance of the main antenna module. In the optimizing examples of the whole invention, the widths of crevice 104 and crevice 105 are both 1 mm.

Figure 3:
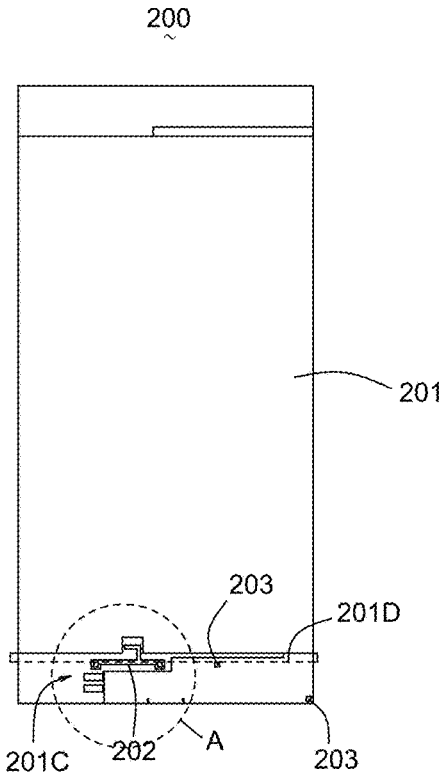
FIG. 3 is a structure diagram of a main antenna module of the full-band antenna system.
Figure 4:
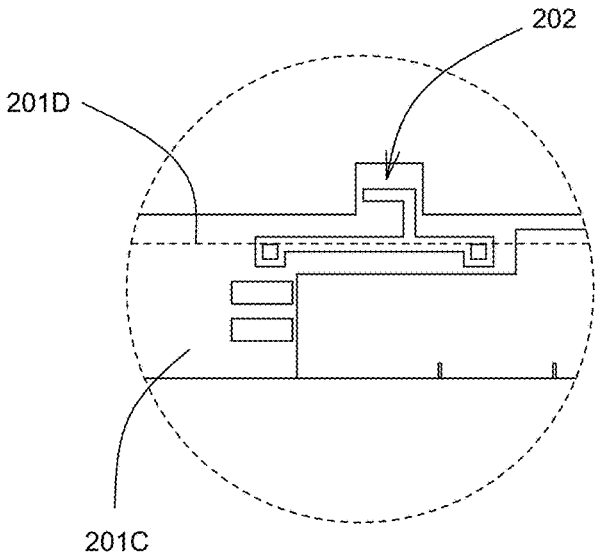
FIG. 4 is an enlarged drawing of Part A in FIG. 3.

As shown in FIG. 3, the main antenna module 200 includes a circuit board 201, a feed part 202 on the circuit board 201, a ground point 203 and a matching circuit. As shown in FIG. 4, the circuit board 201 includes a substrate 201A and an earth plate 201B stacked on the substrate 201A. The feed part 202 and the matching circuit are both on the substrate 201A, and the ground point 203 is on the earth plate 201B. The circuit board 201 can be used together with some normal components, such as loudspeaker and USB interface.

The feed part 202 includes a feeding point 204, a feeding route 205 extending from the feeding point 204, as well as a first feeder branch 206 and a second feeder branch 207 extending from an end of the feeding route 205. And the first feeder branch 206 and the second feeder branch 207 respectively extend in reverse, and they are exactly in line. There are metal shrapnel or elastic metal structure connected with the lower head 103 on the end of both the first feeder branch 206 and the second feeder branch 207. And the first feeder branch 206 and the second feeder branch 207 electrically connect with the lower head 103 directly through the metal shrapnel or elastic metal structure. That is to say, the first feeder branch 206 and the second feeder branch 207 supply electricity to the lower head 103 directly, and take the lower head 103 as a radiator of the main antenna module 200. Actually, the first feeder branch 206, the second feeder branch 207, the lower head 103 and the ground pins 203 collectively form the PIFA (Planar Inverted F-shaped Antenna). And the PIFA can cover the low frequency band (from 700 to 960 MHz) of the main antenna module 200.

The current begins from the first feeder branch 206 and the second feeder branch 207, flows through the lower header 103, and returns to the ground point 203, thus forming a loop antenna. The loop antenna can cover the high frequency band (from 2300 to 2700 MHz) of the main antenna module 200.

In this embodiment of the invention, the quantity of the ground point 203 is two, one of which is in the same line with the first feeder branch 206 as well as the second feeder branch 207. The other ground point 203 is set far away from the first one. Specifically, the other ground point 203 is in the corner of the earth plate 201B, nearby the feed part 202.

It's worth noting that the first feeder branch 206, the second feeder branch 207 and the location of the ground point 203 all will have influence on the radiant efficiency of antenna. So, the positions of the first feeder branch 206, the second feeder branch 207 and the ground point 203 cannot be set up randomly.

The earth plate 201B has a semi-closed gap, and it includes an avoid part 201C used to avoid the feeding part 202, and a gap part 201D used to connect with the avoid part 201C. The gap part 201D is shown as the dashed box in FIG. 3, and it is corresponding to the location of the crevice 105. The semi-closed gap performs the radiation effect, and it can radiate the signal of high frequency band. The gap part 201D must be corresponding to the location of the crevice 105. The correspondence refers that the orthographic projection of the gap part 201D is within the orthographic projection field of the crevice 105. If the location is not corresponding, the metal backing 100 will reduce the radiation effect of the semi-closed gap, then it will cause the radiant efficiency of the main antenna module 200 to decrease. In addition, the length and width of the semi-closed gap are also the key factors that affect the radiant efficiency of the main antenna module. In this embodiment of the invention, the length of the semi-closed gap is 24.5 mm, and the width of the gap part 201D is 1 mm.

Figure 5:
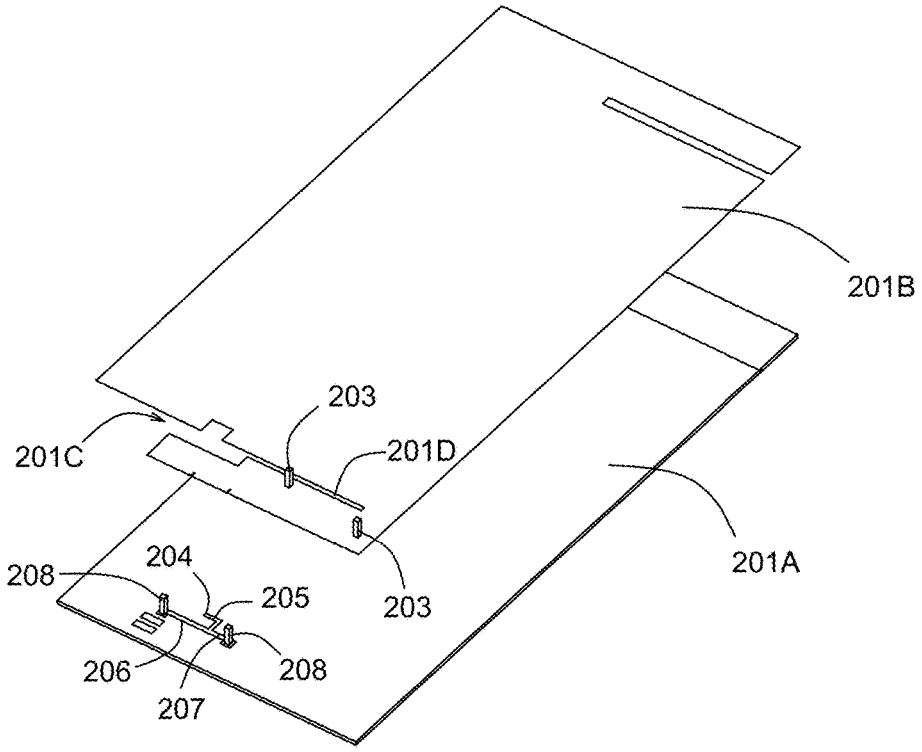
FIG. 5 is a breakdown structure of the main antenna module.
Figure 6:
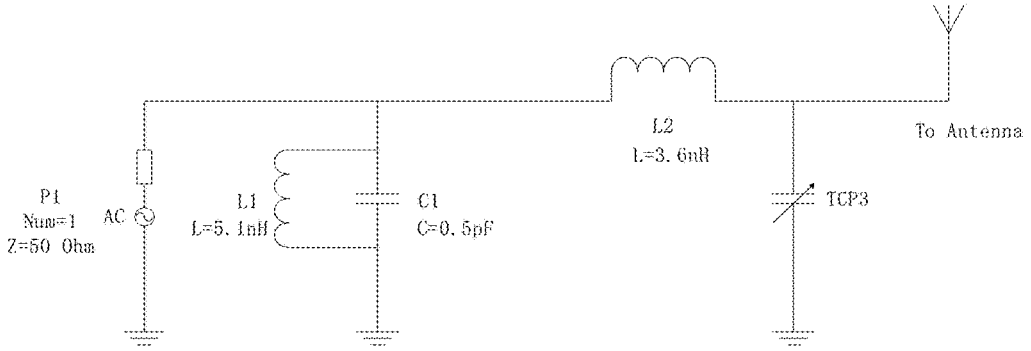
FIG. 6 is an electrical schematic diagram of a matching circuit of the full-band antenna system.

As shown in FIG. 5, the matching circuit mentioned above includes an one-end grounded variable capacitance TCP3, a capacitance C1 that has paralleled connection with the variable capacitance TCP3, (the capacitance C1 is one-end grounded), a first inductance L1 that is parallel connected on both ends of the capacitance C1 as well as a second inductance L2 that is between the capacitance C1 and the variable capacitance TCP3. The main antenna module 200 covers various frequency bands, thus using the matching circuit which is only composed by inductance and capacitance cannot meet the performance request of the full-band antenna for mobile phone on account of the certain values of these inductance and capacitance. In this invention, there are not only certain values of inductance and capacitance in the matching circuit, but also the variable capacitance TCP3. And the matching circuit is added into the feeding route 205, connecting with the electricity of the feeding point 204. By changing the capacitance of the variable capacitance TCP3, the return loss of antenna can be changed accordingly. Thus, it can well meet the performance requests of each frequency bands of the full-band antenna system for a mobile phone.

In this embodiment of the invention, the value of the variable capacitance TCP3 can change from 0.3 pF to 2.97 pF. L1=5.1 nH, L2=3.6 nH, C1=0.5 pF.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A full-band antenna system, including:

a metal backing having two narrow crevices, between which a plurality of intervals are provided, the crevices dividing the metal backing into a header, a middle cover and a lower head;

a main antenna module below the metal backing, the main antenna module including a circuit board comprising a substrate and an earth plate stacked on the substrate, a feed part on the circuit board, a ground point and a matching circuit; the matching circuit including an one-end grounded variable capacity; wherein the feed part and the matching circuit are stacked on the substrate, and the feed part is connected electrically with the matching circuit; the ground point is on the earth plate; the feed part and the ground point both are connected electrically with the lower head; the earth plate has semi-closed gap corresponding to the crevices between the middle cover and the lower head.

2. The full-band antenna system according to claim 1, wherein the matching circuit includes a capacitance parallel connection with a variable capacitance, a first inductance parallel connected on both end of the capacitance, and a second inductance between the capacitance and the variable capacitance.

3. The full-band antenna system according to claim 2, wherein the value of the variable capacitance ranges from 0.3 pF to 2.97 pF.

4. The full-band antenna system according to claim 2, wherein the feed part includes a feeding point, a feeding route extending from the feeding point, a first feeder branch, and a second feeder branch extending from the end of the route; the matching circuit is set on the feeding route, and connects with the electricity of the feeding point; the ends of the first feeder branch and the second feeder branch both connect electrically with the lower head.

5. The full-band antenna system according to claim 4, wherein the first feeder branch and the second feeder branch respectively extend from an end of the feeding route in reverse, and are exactly in the same line.

6. The full-band antenna system according to claim 5, wherein two ground points are provided, one of which is in the same line with the first feeder branch and the second feeder branch.

7. The full-band antenna system according to claim 4, wherein the semi-closed gaps include an avoid part for avoiding the feeding part, and a gap part corresponding to the crevices between the middle cover and the lower head for connecting with the avoid part.

8. The full-band antenna system according to claim 7, wherein a length of the semi-closed gap is 24.5 mm, and a width of the gap part is 1 mm.

9. The full-band antenna system according to claim 1, wherein a width of the crevice is 1 mm.

* * * * *